US005441839A

United States Patent [19]

Ishikawa et al.

[11] Patent Number: 5,441,839

[45] Date of Patent: Aug. 15, 1995

[54] NEGATIVELY CHARGEABLE DEVELOPER WITH CARRIER CONTAINING MAGNESIUM OXIDE

[75] Inventors: Michiaki Ishikawa; Keiko Ogawa; Meizo Shirose; Hiroyuki Takagiwa, all of Hachioji, Japan

[73] Assignee: Konica Corporation, Tokyo, Japan

[21] Appl. No.: 222,933

[22] Filed: Apr. 5, 1994

[30] Foreign Application Priority Data

Apr. 14, 1993 [JP] Japan ..... 5-109803

[51] Int. Cl.[6] ..... G03G 9/113

[52] U.S. Cl. ..... 430/108; 428/407

[58] Field of Search ..... 430/108; 428/407

[56] References Cited

U.S. PATENT DOCUMENTS 5,093,201 3/1992 Ohtani et al. ..... 430/108 X

FOREIGN PATENT DOCUMENTS 94754 6/1982 Japan ..... 430/108
63-235963 9/1988 Japan .
72372 3/1991 Japan ..... 430/108
4-83259 3/1992 Japan .

OTHER PUBLICATIONS

Abstract of 4–83259 (A) of Japan (Date Uncertain).
Abstract of 63–235963 (A) of Japan (Date Uncertain).

*Primary Examiner*—Roland Martin
*Attorney, Agent, or Firm*—Finnegan, Henderson, Farabow, Garrett & Dunner

[57] ABSTRACT

A negative charge developer for electrophotography comprises a toner and a carrier having a core coated with a resin which contains at least one magnesium compound of a magnesium oxide, a magnesium hydroxide or a magnesium carbonate, wherein the magnesium compound has a single crystal structure.

13 Claims, No Drawings

NEGATIVELY CHARGEABLE DEVELOPER WITH CARRIER CONTAINING MAGNESIUM OXIDE

FIELD OF THE INVENTION

The present invention relates to a negative charge developer.

BACKGROUND OF THE INVENTION

The two-component negative charge developer for use in the electrophotography is usually a mixture of a negative charge toner and a positive charge carrier, wherein the carrier is used for the purpose of providing a proper amount of negative triboelectric charge to the toner.

As the carrier a resin-coated carrier consisting of core particles with their surface coated with a resin is suitably used.

In recent years, electrophotographic copying apparatus have a tendency toward being down-sized as seen in laser printers. With this trend, the developing device inside the image copying apparatus is sized small as well.

In the small-sized developing device, however, the quantity of a developer provided for developing the electrostatic latent image becomes necessarily reduced, so that, in the aforementioned two-component negative charge developer, the supplied toner is required to be given a proper amount of negative charge in a short period up to being transported to the developing region, i.e., required to have its charging rise time characteristic improved.

For this reason, the incorporation of a negative charge control agent into the toner has conventionally been prevailing as means to improve the charging rise time characteristic of the negative charge developer.

However, in the small-sized developing device holding a reduced amount of a developer, the addition of a charge control agent to the toner side alone is not enough for improving the charging rise time characteristic, thus resulting in an increase in the amount of weakly charged toner to cause toner scattering to produce fog on the resulting image.

As another means to improve the charging rise time characteristic in the negative charge developer there is introduced a technique to incorporate a positive charge control agent into the resin-coated phase of the resin-coated carrier as described in Japanese Patent Publication Open to Public Inspection (hereinafter abbreviated to JP O.P.I.) No. 8860/1990.

Those known as the positive charge control agent include the quaternary ammonium compounds disclosed in JP O.P.I. Nos. 51951/1974 and 10141/1977, and the alkylpyridinium compounds and alkylpicolium compounds, such as nigrosine SO, nigrosine EX.

These conventionally known positive charge control agents are largely cohesive organic compounds, so that they are inferior in the dispersibility/miscibility with resins for coating.

Therefore, the above positive charge control agent can not be uniformly incorporated into the carrier's resin coat phase, and thus the uneven distribution of the charge control agent or the extrication of the agent from the resin coat phase makes it unable to provide a proper amount of negative triboelectric charge to the toner, resulting in the toner scattering or fog trouble attributable to charging failure.

Further, in the case where the image formation is repeated many times by use of such the negative charge developer, the toner component material is liable to moltenly adhere to the carrier surface. And there also occurs another problem that the tonerspent causes the charge control agent present on the carrier surface to be covered with the toner component material to thereby temporarily lower the charging rise time characteristic.

Incidentally, there has lately been suitably used a positive charge photoreceptor capable of contributing to reducing the discharge amount of ozone and so good for protection of environment, particularly a positive charge type organic photoreceptor or amorphous silicone photoreceptor excellent also in the safety as its component material.

However, the photoreceptor has the disadvantage that its surface tends to be deteriorated due to the contact of it with ozone or paper dust that occurs at the time of the image forming operation. And the deteriorated surface of the photoreceptor invites the lowering of its cleanability (cleaning failure), and causes the resulting image to smear.

Accordingly, in order to prevent the photoreceptor from the cleaning failure and smear to retain its stable performance, it is necessary for the photoreceptor to have its surface polished to remove therefrom the deteriorated layer formed thereon to keep the surface always clean.

As a means to polish the photoreceptor's surface to remove the formed deteriorated layer therefrom, JP O.P.I. No. 81127/1978 discloses a technique for providing a polishing effect to the photoreceptor by the incorporation of an abrasive into the developer.

However, the technique of incorporating the abrasive into the developer is unable to exhibit sufficiently uniformly its polishing effect to photoreceptors having a high surface hardness, such as recent organic photoreceptors and amorphous silicon photoreceptors, and therefore it has not attained any certain measure for preventing the above cleaning failure and image smear problems. In this technique, there are cases where the abrasive extricated from the developer scratches the cleaning blade or stains the wire.

SUMMARY OF THE INVENTION

It is an object of the present invention to provide a negative charge developer capable of stably retaining a good charging rise time characteristic over a long period and causing no toner scattering or fog trouble even when applied to many times repeated runs of the developing process made by use of a small-sized developing device designed for small-scale copying operations.

It is another object of the invention to provide a negative charge developer having a good polishing effect to the photoreceptor surface and causing no cleaning failure or image smear trouble even when applied to an image forming method that uses a high surface hardness-having photoreceptor.

The negative charge developer of the invention is composed of a toner and a resin-coated carrier produced by forming a resin coat phase on the surface of core particles, wherein the resin coat phase comprises at least one magnesium compound selected from the group consisting of magnesium oxide, magnesium hydroxide and magnesium carbonate.

In the negative charge developer of the invention, the magnesium compound contained in the resin coat phase of the resin-coated carrier is preferably of a single crystal structure that has been grown by vapor phase reaction.

DETAILED DESCRIPTION OF THE INVENTION

Improving the Charging Rise Time Characteristic (1) Magnesium oxide, magnesium hydroxide and magnesium carbonate (hereinafter also called 'specific magnesium compounds') are chemically active magnesium-having compounds, whose positive chargeability (negative charge endowing property) is very high. Therefore, the resin-coated carrier containing the compound in its resin coat phase is capable of giving a proper amount of negative triboelectric charge to the toner and has an excellent charging rise time characteristic, so that even when applied to the small-sized developing device, the developer brings about no toner scattering or fog trouble.

(2) The specific magnesium compound having a single crystal structure, since its purity is higher than that of a multi-crystal-structure magnesium compound, has even larger positive chargeability to enable the developer to have its charging rise time characteristic to be even better improved.

The single crystal structure-having specific magnesium compound is obtained in the form of minute particles and excellent in the dispersibility/miscibility with a coat resin, so that the compound is uniformly dispersed into the resin coat phase of the carrier without being extricated/liberated therefrom, and therefore the negative charge amount to be given to the toner can be made optimum.

STABILITY OF CHARGING RISE TIME CHARACTERISTIC (1) The above specific magnesium compounds are each hard inorganic compounds. Accordingly, when carrier particles are frictionally contacted with each other, the toner component (spent toner) sticking to the surface of one carrier is scraped off by the hard magnesium compound present on the surface of another. As a result, even when the image forming operation is repeated many times, the charging rise time characteristic deterioration due to the spent toner can be prevented, thus enabling the stable retention over a long period of the above excellent charging rise time characteristic (2) The presence of the single crystal structure-having specific magnesium compound in the resin coat phase of the carrier makes it possible to exhibit even more excellent spent toner resistance to thereby further improve the stability of the charging rise time characteristic; this is probably because the single crystal structure of the specific magnesium compound has sharp angles, and the sharp angles, by being present on the surface of the carrier, can very effectively scrape out the toner component material remaining sticking to the surface of the carrier.

Polishing Effect on the Photoreceptor's Surface (1) The presence of a hard inorganic compound, the single crystal structure-having specific magnesium compound, on the surface of the carrier exerts an excellent polishing effect on the photoreceptor's surface and enables the secure removal by scrape of the deteriorated layer formed on the surface of the photoreceptor. Accordingly, the photoreceptor, even though its surface hardness is high, can retain its performance stably and thus brings about no cleaning failure or image smear trouble. And since the polishing of the surface of the photoreceptor is carried out by the carrier, the entire surface of the photoreceptor can be uniformly polished without adding any abrasive to the developer, so that at the time of image formation the photoreceptor can always have its surface condition kept satisfactory.

The negative charge developer of the invention is comprised of a toner and a resin-coated carrier produced by forming a resin coat phase on the surface of core particles.

Resin-Coated Carrier

As the core particles of the carrier, although not restricted, magnetic material particles that become strongly magnetized by a magnetic field in its direction, such as, for example, ferrite, magnetite, are suitably usable.

The form of the core particle is not particularly limited, but is preferably spherical. The core particle size is preferably 20 to 200 μm in terms of weight average particle diameter. The specific gravity of the core particle is preferably in the range of 3 to 7 from the viewpoint of preventing the resin coat phase from being broken at the time of mixing by stirring inside the developing device or preventing the toner component material from moltenly sticking onto the surface of the toner.

The resin for constituting the resin coat phase of the carrier can be any resin as long as it is capable of giving negative triboelectric charge to the toner by its friction with the toner, and examples of the resin include styrene resins, acryl resins, styrene-acryl copolymers, and blends of these resins, which are preferred from the standpoint of chargeability endowing property, coat layer formability, and the like.

The weight average molecular weight (Mw) of the coat resin is preferably in the range of 30,000 to 200,000 for improving the durability of the carrier (improving the sticking strength to the core particle).

Specific Magnesium Compound

The resin-coated carrier that constitutes the negative charge developer of the invention contains in its resin coat phase at least one single crystal structure-having magnesium compound selected from the group consisting of magnesium oxide, magnesium hydroxide and magnesium carbonate.

The 'vapor phase reaction' herein means the vapor-vapor reaction for the magnesium compound formation between metallic magnesium vapor and a gas such as oxygen, water vapor, and carbon dioxide.

(1) Magnesium oxide

The single crystal structure-having magnesium oxide to be incorporated into the resin coat phase of the carrier can be prepared in the manner of crystal growth by a vapor reaction. To be concrete, metallic magnesium vapor is oxidized in an oxygen atmosphere for growing its single crystals.

The above prepared magnesium oxide preferably has its surface subjected to hydroxidation treatment (preferably has the outmost surface layer formed with magnesium hydroxide). The hydroxidation treatment of the surface of magnesium oxide can be conducted by having carbon dioxide-free water vapor act on the surface.

(2) Magnesium hydroxide

The single crystal structure-having magnesium hydroxide to be contained in the resin coat phase of the carrier can be prepared in the manner of crystal growth by a vapor reaction. To be concreate, metallic magnesium vapor is hydroxidized in a carbon dioxide-free water vapor atmosphere for growing its single crystals.

(3) Magnesium carbonate

The single crystal structure-having magnesium carbonate to be incorporated into the resin coat phase of the carrier can be prepared in the manner of crystal growth by a vapor reaction. To be concrete, in a carbon dioxide-containing water vapor atmosphere metallic magnesium vapor is made react therewith to thereby grow the single crystals of the metallic magnesium. Examples of the magnesium carbonate include one represented by $MgCO^3$ and magnesium hydroxycarbonate represented by $(3-5)MgCO_3.Mg(OH)_2.(3-7)H_2O$.

The average particle diameter of the specific magnesium compound is preferably in the range of 1 to 500 nm, more preferably 1 to 200 nm, and most preferably 5 to 100 nm.

The average particle diameter herein implies the number average particle diameter obtained in the manner that the observation thereof is made through a transmission-type electron microscope JEM-2000FX, manufactured by Japan Electron Optics Laboratory Co., and then measurement is made by use of an image analyser SPICA, manufactured by Nippon Avionics Co., (the same shall apply hereinater).

The BET specific surface area of the specific magnesium compound is preferably in the range of 500 to 5 $m^2/g$, more preferably 500 to 10 $m^2/g$ and most preferably 200 to 20 $m^2$.

The BET specific surface area herein is a value measured by using a BET specific surface area measuring instrument 'Flow SorbII 2300,' manufactured by Shimazu Seisakusho, Ltd., (the same shall apply hereinafter).

In order to have the spent toner restraining effect and polishing effect on the surface of the photoreceptor sufficiently exhibited, where the average particle diameter of the specific magnesium compound is 1 nm or more, the BET specific surface area is preferably not more than 500 $m^2/g$. On the other hand, in order to have the specific magnesium compound uniformly incorporated into the resin coat phase of the carrier, to prevent extrication of magnesium compound from the resin coat phase to thereby secure the charge endowing property to the toner and to exhibit the photoreceptor's surface polishing effect sufficiently, where the average particle diameter of the specific magnesium compound is less than 500 nm, the BET specific surface area is preferably not less than 5 $m^2/g$.

In order to sufficiently improve the charging rise time characteristic, spent toner restraining effect, polishing effect on the photoreceptor surface, and layer forming property as well as to prevent the resin coat phase from peeling to thereby secure the carrier resistance, the specific magnesium compound content of the resin coat phase of the carrier is preferably 0.5 to 70% by weight and more preferably 1 to 60% by weight.

Method for Producing the Resin-Coated Carrier

For the formation of the specific magnesium compound-containing resin coat phase on the core particle, any methods (coating methods) without restrictions may be used which are broadly classified into two: a wet coating method wherein both coat resin and specific magnesium compound are dissolved/dispersed in a solvent to prepare a coating liquid, and the liquid is coated in the dipping or spray manner on the surface of the core particle, and then the coated layer is dried by heating for removing the solvent to thereby harden the layer, and a dry coating method wherein core particles, resin minute particles for coating and specific magnesium compound particles are mixed by stirring, and the mixture is then subjected to mechanical impact applied repeatedly to thereby form a resin coat layer on the surface of the core particle.

Of these methods the dry coating method is preferred for the reason that it enables not only to form a resin coat layer excellent in the uniformily, surface smoothness and durability but also to improve the charging rise time characteristic.

In the dry coating method,, the resin minute particle for coating preferably has a glass transition point (Tg) of 50° to 200° C. and a softening point (Tsp) of 80° to 300° C. for obtaining a high sticking property to the surface of the core particle and a high durability. The glass transition point Tg and the softening point Tsp of the resin particle can be controlled by selecting the resin's composition and molecular weight, in which the glass transition point Tg is a value measured by using DSC 506S, manufactured by Seiko Denshi Co., while the softening point Tsp is a value measured by using a Flowtester, manufactured by Shimazu Seisakusho, Ltd., (the same shall apply hereinafter).

The number average primary particle diameter of such resin particles is preferably 0.01 to 10 μm, and the form of the resin particle is preferably spherical. Such resin particles can be prepared by suspension polymerization, emulsion polymerization, soap-free polymerization or the like. The above-mentioned number average primary particle diameter of resin particles is a value measured by using a granularity distribution measuring instrument LPA-3000/3100, manufactured by Ohtsuka Denshi Co., (the same shall apply hereinafter).

Toner

The toner constituting the negative charge developer of the invention is not restricted as long as it comprises a binder resin and a coloring agent and negative charge as a result of its friction with the resin-coated carrier, but is preferably mixed with inorganic fine particles supplementarily added thereto from the viewpoint of improving its developing and cleaning capacities. Suitable as the inorganic particles supplementarily added to the toner are silica fine particles, titanium fine particles, etc., that are subjected to surface treatment by alkyl group-containing coupling agents for the reason that they contribute to improving the negative charge-ability endowing effect and the fluidity of the toner.

Suitable as the binder resin for the toner is a polyester resin prone to be negatively charged.

By adding a negative charge control agent to the toner, the charging rise time characteristic can be further improved.

Examples of the negative charge control agent include those 2:1-type metal-containing azo dyes as described in JP O.P.I. Nos. 141452/1982, 7645/1983, 111049/1982, 185653/1983 and 167033/1982, and Japanese Patent Examined Publication (hereinafter abbreviated to JP E.P.) No. 6397/1969; those metallic complexes of aromatic oxycarboxylic acids and aromatic dicarboxylic acids as described in JP O.P.I. Nos. 104940/1982, 111541/1982, 124357/1982 and 127726/1978; and those sulfonylamine derivatives of copper phthalocyanine dyes, sulfonamide derivative dyes of copper phthalocyanine, sulfonamide and sulfonic acid or sulfonic acid salt derivativ dyes of copper phthalocyanine as described in JP O.P.I. No. 45931/1977.

Positively Charging-Type Photoreceptor

As the electrophotographic photoreceptor to which the negative charge developer of the invention is applicable there may be used any photoreceptor without restrictions as long as it is of the positive charge type. Examples of such the photoreceptor include conventional Se photoreceptors, positive charge-type organic photoreceptors, and positive charge-type amorphous silicon photoreceptors.

And the negative charge developer of the invention is suitably applicable to the above-mentioned photoreceptors because the developer is capable of exerting an excellent surface polishing effect even on the positive charge-type organic photoreceptor and positive charge-type amorphous silicon photoreceptor, of which the surface is liable to be deteriorated when in contact with ozone or by paper dust at the time of image formation.

EXAMPLES

In the following examples, the 'part(s)' implies part(s) by weight.

Preparation of carrier samples (Carrier samples 1 to 15 and comparative carrier samples 1 to 3)

The carrier materials used are as follows:

(1) Cu—Zn ferrite particles

Specific gravity: 5.0, weight average particle size: 80 μm, saturation magnetization in an external magnetic field of 1000 Oe: 62 emu/g.

(2) Specific magnesium compound (Magnesium oxide Sample a)

A single crystal magnesium oxide sample prepared by oxidizing a metallic magnesium vapor in an oxygen atmosphere to thereby grow its single crystal.

(Magnesium oxide Samples b to e)

Single crystal magnesium oxide samples prepared in the manner that metallic magnesium vapors are oxidized in an oxygen atmosphere to thereby grow their crystals, and each crystal surface is then subjected to hydroxidizing treatment with carbon dioxide-free water vapor.

(Magnesium oxide sample p)

A multicrystal magnesium oxide sample prepared by the combustion (oxidizing) of metallic magnesium.

(Magnesium hydroxide samples f to j)

Single crystal magnesium hydroxide samples prepared in the manner that metallic magnesium vapors are hydroxidized in a carbon dioxide-free water vapor atmosphere to thereby grow their single crystals.

(Magnesium hydroxide sample q)

A multicrystal magnesium hydroxide sample prepared in the manner that an aqueous solution of magnesium oxide sample P, after adding an alkali thereto, is heated and pressured (Magnesium carbonate sample k)

An hydrous single crystal magnesium carbonate represented by $MgCO_3$.

(Magnesium carbonate samples 1 to 0)

Single crystal magnesium oxycarbonate samples of the composition represented by $3MgCO_3.Mg(OH)_2.3H_2O$.

(Magnesium carbonate sample r )

A multicrystal magnesium hydroxycarbonate, represented by $3MgCO^3.Mg(OH)^2.3H^2O$, prepared in the manner to an aqueous solution of magnesium oxide sample e, with carbon dioxide being conducted thereinto, is added sodium carbonate.

The average particle size, BET specific surface area and the added amount (parts) to 100 parts of Cu—Zn ferrite particles of each of the above magnesium oxide samples a to e and p, magnesium hydroxide samples f to j and q, and magnesium carbonate samples k to o and r are listed in Table 1.

(3) Resin particles for coating

Styrene-methyl methacryalte copolymer resin (copolymer molar ratio: 4/6, glass transition point Tg: 102° C., softening point Tsp: 108° C., average particle size: 0.08 μm). The adding amount (parts) of the resin particles to 100 parts of Cu—Zn ferrite particles are as shown in Table 1.

The above carrier materials (1) to (3) were put into a high-speed stirring mixer LMA-5, manufactured by Nara Kikaiseisakusho Co., and they were subjected to 15-minute stirring/mixing treatment under conditions of material temperature of 30° C. and stirring blade's circumference speed of 10 m/sec, whereby a mixture of Cu—Zn ferrite particles with their surface having the specific magnesium compound and resin particles for coating uniformly attached thereto was obtained. Subsequently, mechanical impact was repeatedly applied to the mixture while continuing its stirring for 40 minutes under conditions of a material temperature of 100° C. and stirring blade's circumference speed of 10 m/sec, whereby carrier samples 1 to 15 (for the invention), comprising Cu—Zn particles having their surface covered with a resin coat layer, and comparative carrier samples 1 to 3 were prepared.

TABLE 1

| Carrier Sample No. | Specific compound Kind | | Average particle size (nm) | BET specific surface($m^2$/g) | Added amount (parts) | Resin particles Added amt (parts) |
|---|---|---|---|---|---|---|
| 1 (Inv.) | Magnesium oxide | a | 12 | 152 | 0.2 | 1.8 |
| 2 (Inv.) | Magnesium oxide | b | 15 | 155 | 0.2 | 1.8 |
| 3 (Inv.) | Magnesium oxide | c | 51 | 31 | 0.6 | 1.4 |
| 4 (Inv.) | Magnesium oxide | d | 111 | 14 | 0.6 | 1.4 |
| 5 (Inv.) | Magnesium oxide | e | 182 | 12 | 0.6 | 1.4 |
| 6 (Inv.) | Magnesium hydroxide | f | 11 | 161 | 0.2 | 1.8 |
| 7 (Inv.) | Magnesium hydroxide | g | 23 | 158 | 0.2 | 1.8 |
| 8 (Inv.) | Magnesium hydroxide | h | 43 | 71 | 0.6 | 1.4 |
| 9 (Inv.) | Magnesium hydroxide | i | 125 | 13 | 0.6 | 1.4 |
| 10 (Inv.) | Magnesium hydroxide | j | 191 | 13 | 0.6 | 1.4 |
| 11 (Inv.) | Magnesium carbonate | k | 9 | 175 | 0.2 | 1.8 |
| 12 (Inv.) | Magnesium carbonate | l | 12 | 162 | 0.2 | 1.8 |
| 13 (Inv.) | Magnesium carbonate | m | 51 | 66 | 0.6 | 1.4 |
| 14 (Inv.) | Magnesium carbonate | n | 110 | 13 | 0.6 | 1.4 |

TABLE 1-continued

| Carrier Sample No. | Specific compound Kind | | Average particle size (nm) | BET specific surface($m^2/g$) | Added amount (parts) | Resin particles Added amt (parts) |
|---|---|---|---|---|---|---|
| 15 (Inv.) | Magnesium carbonate | o | 186 | 12 | 0.6 | 1.4 |
| 1 (Comp.) | Magnesium oxide (multicrystal) | p | 210 | 9 | 1.2 | 0.8 |
| 2 (Comp.) | Magnesium hydroxide (multicrystal) | q | 241 | 8 | 1.2 | 0.8 |
| 3 (Comp.) | Magnesium carbonate (multicrystal) | r | 235 | 9 | 1.2 | 0.8 |
| 4 (Comp.) | Nigrosine SO | s | 300 | 5 | 0.06 | 1.94 |
| 5 (Comp.) | Magnetite | t | 200 | 7 | 1 | 1 |

Comparative Carrier Sample 4

Comparative carrier sample 4, comprising Cu—Zn ferrite particles having the surface thereof covered with a resin coat phase, was prepared in the same manner as in carrier sample 1 except that as the carrier material 100 parts of the foregoing Cu—Zn ferrite particles, 1.94 parts of the foregoing resin particles for coating, and 0.06 parts of nigrosine SO (average particle size: 300 nm, BET specific surface area 5 $m^2/g$) were used.

Comparative Carrier Sample 5

Comparative carrier sample 5, comprising Cu—Zn ferrite particles having the surface thereof covered with a resin coat phase, was prepared in the same manner as in carrier sample 1 except that as the carrier material 100 parts of the foregoing Cu—Zn ferrite particles, 1.0 part of the foregoing resin particles for coating, and 1.0 part of magnetite (average particle size: 200 nm, BET specific surface area: 7 $m^2/g$.

Preparation of Toner

One hundred parts of a polyester resin, 10 parts of carbon black, 5 parts of polypropylene and 3 parts of a negatively chargeable charge control agent Spiron-black TRH, produced by Hodogaya Chemical Industry Co., were mixed, kneaded, pulverized and classified, whereby colored particles having an average particle size of 8 μm were obtained.

One hundred parts of the above colored particles and 2.0 parts of hydrophobic silica particles (particle size: 16 nm) were mixed by a Henshel mixer to thereby prepare a toner.

Examples 1 to 15 and Comparative Examples 1 to 5

Ninety-five parts of each of carrier samples 1 to 15 and comparative carrier samples 1 to 5 and 5 parts of the above toner were mixed, whereby negative charge developer samples 1 to 15 of the invention and comparative negative charge developer samples 1 to 5 were produced.

Practical Copying Tests

Each of the above prepared developer samples 1 to 15 and comparative developer samples 1 to 5 was subjected to 70,000 times repeated run of practical copying tests by using an electrophotographic UBix-1112-remodelled copier, manufactured by KONICA Corp., and evaluations were made on the items (1) the stain inside the copier due to toner scattering, (2) the appearance of fog, (3) spent-resistant characteristic, (4) cleanability and (5) the presence of smear on copied images in the stage after making 50,000 copies and further in the stage after making 70,000 copies.

The remodelled points and the image-forming conditions of the electrophotographic copier that was used for the image formation are as follows:

Photoreceptor

The following OPC photoreceptor and amorphous silicon photoreceptor (hereinafter called 'a—Si photoreceptor') were prepared, and the practical copying tests were conducted with these photoreceptors mounted on the electrophotographic copier.

(1) OPC Photoreceptor i Formation of subbing layer

On an alminum substrate of 60 mm in diameter was provided a 0.1 μm-thick sublayer comprised of a vinyl chloride-vinyl acetate-maleic anhydride copolymer 'Eslec MF-10,' manufactured by Sekisui Chemical Industry Co.

ii Formation of charge transport layer

On the sublayer was provided a charge transport layer of 30 μm in thickness comprised of the following composition:

| (Composition of charge transport layer) | |
|---|---|
| Polycarbonate PCZ-200 (produced by Mitsubishi Gas Chemicals Co.) | 100 parts |
| Charge transport material composed of the compound having the following formula | 100 parts |
| Antioxidant Inorganox 1010 (produced by Ciba Geigy Co.) | 10 parts |

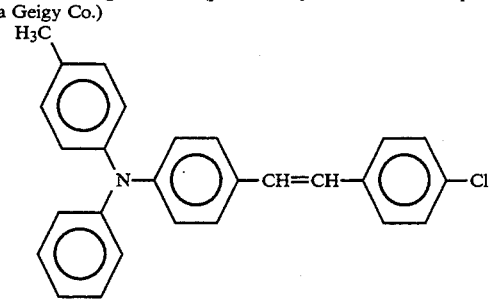

iii Formation of charge generation layer

On the charge transport layer was provided a charge generation layer of 5 μm in thickness composed of the following composition:

| (Composition of charge generation layer) | |
|---|---|
| Polycarbonate PCZ-200 (produced by Mitsubishi Gas Chemicals co.) | 200 parts |
| Charge generation material (dibromoanthanthrone) | 100 parts |
| Charge transport material composed of the compound shown above | 100 parts |

(2) a—-Si Photoreceptor

A smooth surface-having drum-shaped aluminum substrate, after cleaning its surface, was placed inside a vacuum chamber, the gas pressure inside the vacuum chamber was adjusted to $10^{-8}$ Torr, and the substrate was heated to and kept at a temperature within the range of 100° to 350° C.

Subsequently, a high-purity argon gas was conducted as a carrier gas into the chamber, 13.56 MHz high-frequency electric power were applied under a back pressure of 0.5 Torr, and 10 -minute predischarging took place. Next, a reaction gas composed of $SiH_4$, $CH_4$ and $B_2H_6$ was conducted and a mixture of the Ar, $SiH_4$, $CH_4$ and $B_2H_6$ gases in a flow ratio of $1:1:1:1.5\times10^{-3}$ was subjected to glow discharge decomposition, whereby a charge blocking layer composed of $P^+$-type a—Si:C:H layer, a charge transport layer composed of a—Si:C:H layer (provided, $[B_2H_6]/[SiH_4]=10$ppm by volume, [C]=10 atm %), and an intermediate layer composed of a—Si:C:H layer (provided, $[B_2H_6]/[SiH_4]=9$ ppm by volum, [C]=5 atm%) were formed in sequence at a deposition speed of 6 μm/hr on the substrate, wherein the charge blocking layer is 0.5 μm in thickness, the charge transport layer is 10 μm in thickness and the intermediate layer is 1 μm in thickness.

Then, the supply of $CH_4$ and other gases is stopped, and $SiH_4$ and $B_2H_6$ are subjected to discharge decomposition to thereby form a charge generation layer composed of 0.1 μm-thick a—Si:H layer (provided, $[B_2H_6]/[SiH_4]=0.1$ ppm by volume) on the above intermediate layer.

Subsequently, reforming gases of $O_2$, $CH_4$ and $N_2$ in a flow ratio of 20:60:20, while being conducted into the vacuum chamber, were subjected to discharge decomposition treatment to thereby form a 0.05 μm-thick surface reforming layer on the above charge generation layer, whereby an a—Si photoreceptor was prepared.

Other Remodelled Points and Image Forming Conditions

Discharge polarity in the charging section

The polarity was changed from negative to positive, and adjustment was made so that the photoreceptor's electric potential in the image area is 750 V, while that in the non-image area is 50 V.

Discharge polarity in the transfer section

Changed from negative to positive.

Development bias voltage

Changed to −150 V.

Evaluations for the respective test items were made as follows:

(1) Stain inside the apparatus due to toner scattering

After making 50,000 copies and 70,000 copies in the practical copying test run, the inside of the copier was visually examined for evaluation. The evaluated results were classified into 4: A, B, C and D which are defined as follows:

A: No stain was found at all.

B: Stain was partially found on the top cover (near the sleeve) of the developing device.

C: The entire area of the top cover of the developing device was found stained.

D: The inside of the apparatus was overall stained due to toner scattering, so practically unacceptable.

(2) Occurrence of fog

The absolute densities of the fog that occurred on the non-image white background areas of the 50,000th and 70,000th image copies that were obtained in the practical copying test run were measured with a densitometer RD918, manufactured by Macbeth Co., wherein the absolute density of the copying paper used was 0.091.

(3) Spent-resistant characteristic (measurement of covering rate)

In the stages after making 50,000 and 70,000 copies, the developer was recovered and washed to separate/remove the toner therefrom, and then dried to have its weight (carrier weight a) measured. From the measured carrier weight a and the magnetic particles' weight b the covering rate C was found according to the following equation:

$$C=(a-b)/b\times100\ [\%\text{ by weight}]$$

The covering rate C in the initial stage is 2.0 % by weight, and the larger the value, the more inferior the spent-resistant characteristic.

(4) Cleanability

Copied image sampling was made every one thousand copies-making operations, and the cleanability was evaluated in terms of the number of copying times required by the time when image stain attributable to cleaning failure occurred.

(5) Image smear

The image qualities after 50,000 and 70,000 copies making operations in the practical copying test run were visually examined for evaluation. The evaluated results were classified into 4: A, B, C and D which are defined as follows:

A: No image smear was found at all.

B: An image smear partially appeared but was so slight as not to hinder letters' legibility.

C: An image smear appeared in the extent to hinder letters' legibility.

D: The overall image was found so badly smeared that letters are unlegible.

The above evaluation results are shown in Table 2 (tests with OPC photoreceptors) and Table 3 (tests with a—Si photoreceptors).

TABLE 2 (1)

| With OPC photoreceptor | | 50,000 copies making operation | | | | |
|---|---|---|---|---|---|---|
| Developer | Carrier | Toner scatter | Fog | Covering rate(wt %) | Cleaning failure | image smear |
| 1 (Inv.) | 1 (Inv.) | A | 0.091 | 1.98 | None | A |
| 2 (Inv.) | 2 (Inv.) | A | 0.091 | 1.89 | " | A |
| 3 (Inv.) | 3 (Inv.) | A | 0.091 | 1.98 | " | A |
| 4 (Inv.) | 4 (Inv.) | A | 0.093 | 1.99 | " | A |
| 5 (Inv.) | 5 (Inv.) | A | 0.092 | 1.98 | " | A |
| 6 (Inv.) | 6 (Inv.) | A | 0.091 | 1.92 | " | A |
| 7 (Inv.) | 7 (Inv.) | A | 0.092 | 1.99 | " | A |
| 8 (Inv.) | 8 (Inv.) | A | 0.091 | 1.93 | " | A |
| 9 (Inv.) | 9 (Inv.) | A | 0.093 | 1.99 | " | A |
| 10 (Inv.) | 10 (Inv.) | A | 0.091 | 1.98 | " | A |
| 11 (Inv.) | 11 (Inv.) | A | 0.091 | 1.91 | " | A |
| 12 (Inv.) | 12 (Inv.) | A | 0.091 | 1.99 | " | A |
| 13 (Inv.) | 13 (Inv.) | A | 0.092 | 1.95 | " | A |
| 14 (Inv.) | 14 (Inv.) | A | 0.093 | 1.98 | " | A |
| 15 (Inv.) | 15 (Inv.) | A | 0.092 | 1.97 | " | A |
| 1 (Comp.) | 1 (Comp.) | A | 0.093 | 2.08 | " | B |
| 2 (Comp.) | 2 (Comp.) | A | 0.094 | 2.08 | " | B |
| 3 (Comp.) | 3 (Comp.) | A | 0.094 | 2.11 | " | B |
| 4 (Comp.) | 4 (Comp.) | B | 0.135 | 2.66 | Occurred*1 | D |
| 5 (Comp.) | 5 (Comp.) | D | 0.148 | 2.56 | Occurred*2 | D |

Note:
*1After making 30,000 copies.
*2After making 35,000 copies.

TABLE 2 (2)

| With OPC photoreceptor | | 70,000 copies making operation | | | | |
|---|---|---|---|---|---|---|
| Developer | Carrier | Toner scatter | Fog | Covering rate(wt %) | Cleaning failure | image smear |
| 1 (Inv.) | 1 (Inv.) | A | 0.092 | 1.97 | None | A |
| 2 (Inv.) | 2 (Inv.) | A | 0.091 | 1.88 | " | A |
| 3 (Inv.) | 3 (Inv.) | A | 0.092 | 1.99 | " | A |
| 4 (Inv.) | 4 (Inv.) | A | 0.092 | 1.99 | " | A |
| 5 (Inv.) | 5 (Inv.) | A | 0.092 | 1.98 | " | A |
| 6 (Inv.) | 6 (Inv.) | A | 0.091 | 1.91 | " | A |
| 7 (Inv.) | 7 (Inv.) | A | 0.092 | 1.95 | " | A |
| 8 (Inv.) | 8 (Inv.) | A | 0.092 | 1.98 | " | A |
| 9 (Inv.) | 9 (Inv.) | A | 0.091 | 1.98 | " | A |
| 10 (Inv.) | 10 (Inv.) | A | 0.091 | 1.97 | " | A |
| 11 (Inv.) | 11 (Inv.) | A | 0.093 | 1.91 | " | A |
| 12 (Inv.) | 12 (Inv.) | A | 0.091 | 1.99 | " | A |
| 13 (Inv.) | 13 (Inv.) | A | 0.092 | 1.95 | " | A |
| 14 (Inv.) | 14 (Inv.) | A | 0.091 | 1.98 | " | A |
| 15 (Inv.) | 15 (Inv.) | A | 0.091 | 1.97 | " | A |
| 1 (Comp.) | 1 (Comp.) | C | 0.112 | 2.28 | " | D |
| 2 (Comp.) | 2 (Comp.) | C | 0.128 | 2.35 | Occurred*3 | C |
| 3 (Comp.) | 3 (Comp.) | C | 0.127 | 2.44 | Occurred*4 | D |
| 4 (Comp.) | 4 (Comp.) | | | Discontinued after 50,000 copies. | | |
| 5 (Comp.) | 5 (Comp.) | | | Discontinued after 50,000 copies. | | |

Note:
*3After making 65,000 copies.
*4After making 65,000 copies.

TABLE 3 (1)

| With a-Si photoreceptor | | 50,000 copies making operation | | | | |
|---|---|---|---|---|---|---|
| Developer | Carrier | Toner scatter | Fog | Covering rate(wt %) | Cleaning failure | image smear |
| 1 (Inv.) | 1 (Inv.) | A | 0.092 | 1.96 | None | A |
| 2 (Inv.) | 2 (Inv.) | A | 0.091 | 1.92 | " | A |
| 3 (Inv.) | 3 (Inv.) | A | 0.091 | 1.94 | " | A |
| 6 (Inv.) | 6 (Inv.) | A | 0.093 | 1.96 | " | A |
| 7 (Inv.) | 7 (Inv.) | A | 0.091 | 1.93 | " | A |
| 8 (Inv.) | 8 (Inv.) | A | 0.091 | 1.98 | " | A |
| 11 (Inv.) | 11 (Inv.) | A | 0.092 | 1.98 | " | A |
| 12 (Inv.) | 12 (Inv.) | A | 0.091 | 1.94 | " | A |
| 13 (Inv.) | 13 (Inv.) | A | 0.093 | 1.99 | " | A |
| 1 (Comp.) | 1 (Comp.) | C | 0.142 | 2.84 | Occurred*5 | C |
| 2 (Comp.) | 2 (Comp.) | C | 0.155 | 2.62 | Occurred*6 | B |

Note:
*5After making 30,000 copies.
*6After making 35,000 copies.

TABLE 3 (2)

| With a-Si photoreceptor | | 70,000 copies making operation | | | | |
|---|---|---|---|---|---|---|
| Developer | Carrier | Toner scatter | Fog | Covering rate(wt %) | Cleaning failure | image smear |
| 1 (Inv.) | 1 (Inv.) | A | 0.092 | 1.96 | None | A |
| 2 (Inv.) | 2 (Inv.) | A | 0.089 | 1.91 | " | A |
| 3 (Inv.) | 3 (Inv.) | A | 0.091 | 1.93 | " | A |
| 6 (Inv.) | 6 (Inv.) | A | 0.092 | 1.95 | " | A |
| 7 (Inv.) | 7 (Inv.) | A | 0.089 | 1.94 | " | A |
| 8 (Inv.) | 8 (Inv.) | A | 0.089 | 1.97 | " | A |
| 11 (Inv.) | 11 (Inv.) | A | 0.089 | 1.97 | " | A |
| 12 (Inv.) | 12 (Inv.) | A | 0.092 | 1.95 | " | A |
| 13 (Inv.) | 13 (Inv.) | A | 0.092 | 1.95 | " | A |
| 1 (Comp.) | 1 (Comp.) | | | Discontinued after 50,000 copies. | | |
| 2 (Comp.) | 2 (Comp.) | | | Discontinued after 50,000 copies. | | |

The negative charge developer of the invention is capable of stably exhibiting its good charging rise time characteristic over a long period of time and causes no toner scattering or fog trouble even when applied to repeated runs of developing process in a small-sized developing device. The developer also have an excellent polishing effect on the photoreceptor surface and, even when used in an image forming method that uses a high surface hardness-having photoreceptor, causes no cleaning failure or image smear trouble.

The negative charge developer of the invention contributes to further improvement of the charging rise time characteristic, stabilization of the charging rise time characteristic, and exertion of even more improved polishing effect on the surface of the photoreceptor.

An object of the present invention is to provide a negative charge developer capable of stably retaining a good charging rise time characteristic over a long period and causing no toner scattering or fog trouble even when applied to many times repeated runs of the developing process made by use of a small-sized developing device designed for small-scale copying operations.

Another object of the invention is to provide a negative charge developer having a good polishing effect on the photoreceptor surface and causing no cleaning failure or image smear trouble even when applied to an image forming method that uses a high surface hardness-having photoreceptor.

The negative charge developer of the invention comprises a resin-coated carrier and a toner, said resin-coated carrier containing in its resin coat phase at least one magnesium compound (preferably a single crystal structure-having magnesium compound) selected from the group consisting of magnesium oxide, magnesium hydroxide and magnesium carbonate.

What is claimed is:

1. A negative charge developer for electrophotography comprising:

a toner, a carrier having a core coated with a resin which contains at least one magnesium compound selected from the group consisting of a magnesium oxide, a magnesium hydroxide and a magnesium carbonate, wherein the magnesium compound has a single crystal structure.

2. The negative charge developer of claim 1 wherein the magnesium compound having the single crystal structure and is prepared from a vapor phase chemical reaction.

3. The negative charge developer of claim 1 wherein an average particle size of the magnesium compound is 1 to 500 nm.

4. The negative charge developer of claim 3 wherein an average particle size of the magnesium compound is 1 to 200 nm.

5. The negative charge developer of claim 4 wherein an average particle size of the magnesium compound is 5 to 100 nm.

6. The negative charge developer of claim 1 wherein a BET specific surface area of the magnesium compounds is 500 to 5 $m^2$ per gram.

7. The negative charge developer of claim 6 wherein a BET specific surface area of the magnesium compounds is 500 to 10 $m^2$ per gram.

8. The negative charge developer of claim 7 wherein a BET specific surface area of the magnesium compounds is 200 to 20 $m^2$ per gram.

9. The negative charge developer of claim 1 wherein a content of the magnesium compound in the resin is 0.5 to 70 weight %.

10. The negative charge developer of claim 9, wherein a content of the magnesium compound in the resin is 1 to 60 weight %.

11. A negative charge developer for electrophotography comprising:

a toner, a carrier having a core coated with a resin by a dry coating method in which said resin contains at least one magnesium compound which has a single crystal structure and is prepared from a vapor phase chemical reaction, selected from the group consisting of a magnesium oxide, a magnesium hydroxide and a magnesium carbonate, wherein an average particle size of the magnesium compound is 5 to 100 nm;

a BET specific surface area of the magnesium compounds is 200 to 20 $m^2$ per gram and a content of the magnesium compound in the resin layer is 1 to 60 weight %.

12. The negative charge developer of claim 11 wherein the resin has a glass transition point of 50° to 200° C. and a softening point of 80° to 300° C. and an average primary particle diameter of the resin is 0.01 to 10 $\mu$m.

13. The negative charge developer of claim 12, wherein the toner contains a polyester resin binder, a coloring agent, inorganic particles selected from the group consisting of silica and titania both treated with an alkyl group-containing coupling agent.

* * * * *